US005209347A

United States Patent [19]

Fabisiewicz et al.

[11] Patent Number: 5,209,347

[45] Date of Patent: May 11, 1993

[54] INTERNAL TEAR SEAL DUAL BAG

[75] Inventors: Eugene Fabisiewicz, Mt. Prospect; Jack Fagan, Lindenhurst; Steffen A. Lyons, Libertyville, all of Ill.

[73] Assignee: Clintec Nutrition Company, Deerfield, Ill.

[21] Appl. No.: 624,875

[22] Filed: Dec. 5, 1990

[51] Int. Cl.[5] ..... B65D 30/22; B65D 81/32

[52] U.S. Cl. ..... 206/219; 383/38; 604/410

[58] Field of Search ..... 206/219, 221, 222; 383/38, 210, 211; 604/409, 410

[56] References Cited

U.S. PATENT DOCUMENTS

| | | | |
|---|---|---|---|
| 2,916,197 | 12/1959 | Detrie et al. | 206/319 |
| 3,217,871 | 11/1965 | Lee | 383/211 |
| 3,510,054 | 5/1970 | Sanni et al. | 383/210 |
| 3,964,604 | 6/1976 | Prenntzell | 206/219 |
| 4,458,811 | 7/1984 | Wilkinson | 206/219 |
| 4,519,499 | 5/1985 | Stone et al. | 206/219 |
| 4,629,080 | 12/1986 | Carveth | 206/219 |
| 4,770,295 | 9/1988 | Carveth et al. | 296/219 |
| 4,961,495 | 10/1990 | Yoshida et al. | 206/219 |

*Primary Examiner*—Jimmy G. Foster

*Attorney, Agent, or Firm*—Hill, Steadman & Simpson

[57] ABSTRACT

A W-shaped frangible seal line separating at least two chambers in a container or securing together two sheets of material. Outer legs of the W-shape preferably describe an angle of 170° or less. Inner legs of the W-shape preferably describe an upside down chevron or V-shape that describes an acute angle.

13 Claims, 1 Drawing Sheet

INTERNAL TEAR SEAL DUAL BAG

BACKGROUND OF THE INVENTION

The present invention generally relates to multichamber containers having a selectively openable seal line between two chambers. More particularly, the invention relates to dual chamber bags for delivery of medical substances to a patient, e.g., via an administration set.

In the medical field it is often necessary to mix two separate components such as a drug into a diluent or a dextrose and amino acids. The components of such mixtures must often be stored separately. In the case of amino acids and dextrose, for example, the mixture is not stable over long periods of time. Such instability may also be true for the mixture of a drug in a diluent. Also, some drugs lose their efficacy when stored in a liquid diluent and must be stored in a powdered form and reconstituted prior to use.

Due to the characteristics of the different components, it may be necessary to sterilize the components separately, therefore the components may be combined only after each component is separately sterilized. For example, some liquid diluents, such as sterile water, are sterilized by steam sterilization, or autoclaving. The heat generated during such sterilization procedure may destroy the efficacy of many powdered drugs which, by necessity, should be sterilized by other means.

Although it is possible to separately store two components, it is desireable to quickly and easily mix the components in a closed system under sterile conditions.

It is known to provide a multiple chamber container of flexible plastic sheets having heat seal dividing the container into two or chambers. Such a container is disclosed, for example, in U.S. Pat. Nos. 4,396,388; 4,770,295; 3,950,158; 4,000,996; and 4,226,330.

In U.S. Pat. No. 4,396,488, there is disclosed a container which employs frangible valves between the heat seal to allow for selective communication and mixing between the two components stored in the two chambers.

However, it is desirable to provided a multiple chamber closed system which does not require additional elements integrated into the container to form the openable valve between the compartments. In each of U.S. Pat. Nos. 3,950,158; 4,000,996; and 4,226,330, there is disclosed a multiple chamber container which has a line of weakness, such as a score line and plastic material, which breaks upon the application of pressure.

In U.S. Pat. No. 4,770,295, a selectively open seal line is positioned between two sheets of flexible thermoplastic material, the seal line being exceptionally resistent to unintentional opening forces but easily opening upon application of a specific force. It is disclosed that the seal line may be employed in various containers, including a two chamber container for the separate storage and selective mixing of two medical substances. The container includes two sheets forming the exterior of the container and an inner diaphragm sheet between the outer sheets. One selectively openable seal is disposed between one of the outer sheets and diaphragm sheet. Preferably, a permanent line of securement is also included between the other exterior sheet and the inner diaphragm sheet extending substantially parallel to and coextensive with the openable seal line.

Tear tabs or tear strips for plastic packaging are also known, such as shown in U.S. Pat. No. 2,991,000. Such tear tabs provide ready access to the contents of a container but also involve the use of a relatively complicated seal structure. U.S. Pat. No. 3,983,994 discloses a peelable seal broken by pulling upon tabs located outside of the container.

Rupturable seal lines such as shown in the above-named patents may suffer from what is regarded as pooling of solution when the rupturable seal line is broken. In such a case, not all of the substance in one of the containers mixes with the other substance because it is captured within pockets defined by the rupturable seal line.

Further, it is desirable to provide for inspection of the seal line for leaks.

SUMMARY OF THE INVENTION

The present invention provides an internal tear seal container having at least two chambers that are selectively disposed in communication by rupturing of a seal formed therebetween wherein pooling of solution within pockets defined by the seal is eliminated. The present invention further provides for an internal tear seal bag which can be inspected for leaks by appropriate supporting of the container.

To these ends, an embodiment of the invention provides a multichambered container including a selectively openable seal line connecting two sheets of material, the openable seal line being exceptionally resistent to unintentional opening but easy to open upon the application of a specific force, the selectively openable seal having a configuration that provides a larger opening for the same amount of stretch between the two sheets when they are pulled.

In one embodiment, the invention provides a selectively openable seal line connecting two sheets of material wherein the seal line is configured to have substantially a overall W-shape with an inversely extending central chevron portion.

In one particular embodiment, the invention provides that the inversely extending central chevron portion comprises a height of about one inch or greater.

In another particular embodiment, the overall W-shape of the seal line is such that two outer legs of the W-shape define angle of about 170°.

These and other features of the invention as well as advantages thereof will become apparent with reference to the following detailed description of the presently preferred embodiments and accompanying drawings.

DETAILED DESCRIPTION OF THE PRESENTLY PREFERRED EMBODIMENTS

Figure 4:
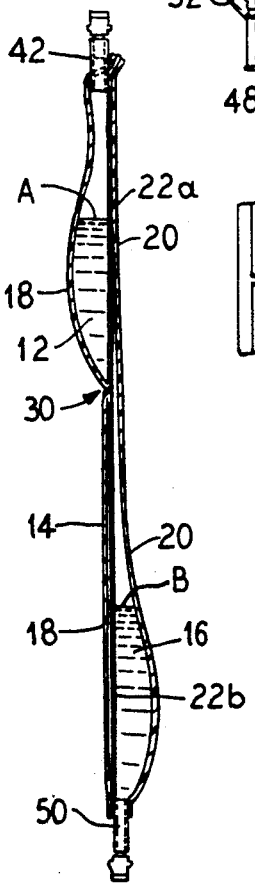
FIG. 4 is a sectional view of the container of FIG. 1 taken generally along the line IV—IV.
Figure 5:
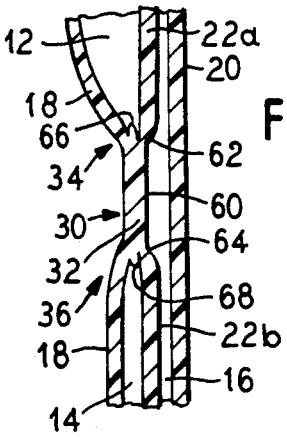
FIG. 5 is an enlarged sectional view of the internal tear seal of FIG. 3 taken generally along the line V—V.
Figure 6:
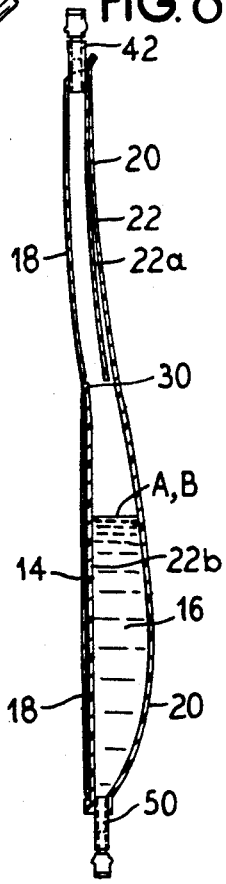
FIG. 6 is a sectional view similar to that of FIG. 4 but illustrating the seal in a ruptured state.

Referring to FIGS. 1–6, and in particular to FIGS. 4 and 6, there is illustrated a multichambered container 10 provided with three chambers 12, 14, and 16 for the separate storage of up to three substances and/or solutions. As illustrated, the container 10 preferably is configured for delivery of such medical substances (e.g. an admixed injection) to a patient, for example, intravenously or enterally via an administration set. As a particular example, a liquid A (e.g., a dextrose solution) is contained within chamber 12 while another liquid B (e.g., an amino acid solution such as Travasol®, manufactured by Baxter Health Care Corporation, Deerfield, Ill.) is contained within chamber 16.

The container 10 is formed by appropriate attachment of a first exterior sheet 18 and a second exterior sheet 20 to a third inner sheet 22, the peripheries 23 of which are secured together, for example, via heat sealing. An internal tear seal 30, described more fully below, is provided between the sheets 18 and 20 to form the chambers 12 and 14 and allow communication therebetween.

Figure 1:
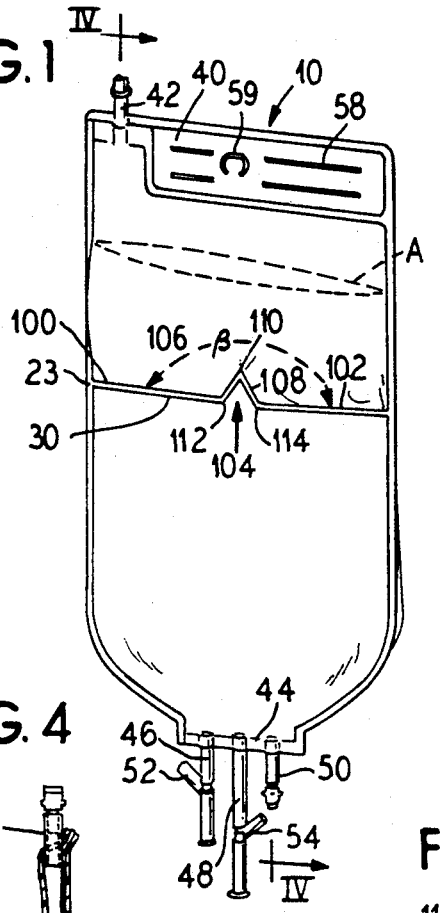
FIG. 1 is a perspective view of the front side of a multichamber internal tear seal container.
Figure 2:
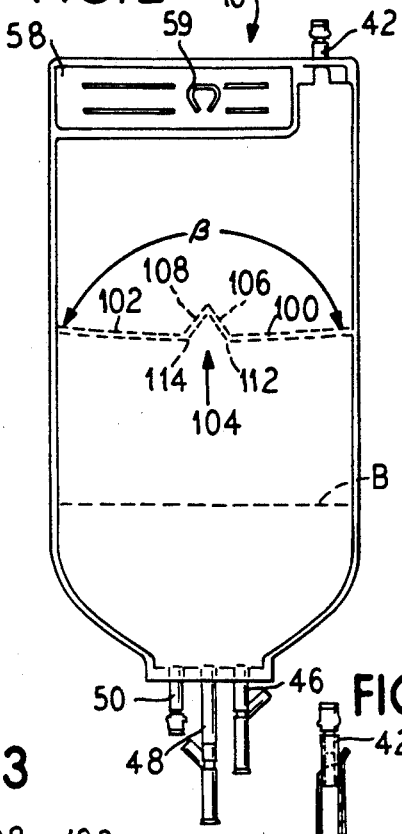
FIG. 2 is an elevational view of the back side of the container of FIG. 1.

As illustrated in FIGS. 1, 2, and 4, disposed at a top end 40 of the container 10 is a tubular port 42. This port 42 provides communication with the chamber 12 and can include a suitable membrane covering that can be pierced by, for example, a cannula or spike of an administration set so that additional substances can be aseptically added to the chamber 12. Disposed at a bottom end 44 of the container 10 are three tubular ports 46, 48, and 50 through which the medical substances are discharged to a patient. The tubular ports 46, 48, and 50 are mounted in the container to communicate with the interior of the container via the chamber 16. The ports 46, 48, and 50 can include a membrane (not shown) that is pierced by, for example, the cannula or spike of a parenteral administration set for delivery of the container contents through the administration set to the patient. Y-shaped adaptors 52 and 54 on the ports 46 and 48 allow for the aseptic addition of further substances to the patient and/or evacuation of substances through such ports.

Provided at the top end 40 of the container is a strengthened flattened area 58 formed by appropriate heat sealing through the layers 18, 20, and 22. The area 58 is strengthened because it comprises a solid layer having a thickness equal to the sum of the thickness of the layers 18, 20, and 22. Accordingly, there is provided an anchor opening 59 therein for appropriate supporting of the containers 10 from, e.g., a hook.

As illustrated best in FIGS. 4 and 5, particularly FIG. 5 where the internal tear seal 30 is depicted in cross-sectional view, the tear seal 30 includes various aspects. A middle portion 32 comprises a solid weld so that there is no communication between the chambers 12 and 14. Disposed or formed on opposite sides of the solid weld 32 is a frangible seal line 34.

Essentially, the solid weld 32 divides the sheet 22 into two sections 22A and 22B, section 22A serving as one wall for the chamber 12, section 22B serving as one wall for the chamber 14. The frangible seal line 34 connects the section 22A to the weld 32, while a seal line 36 connects the section 22B to the opposite side of the weld 32. At the same time, the sections 22A and 22B still jointly serve as one wall of the chamber 16, the other wall being the sheet 20.

It can be appreciated that rupturing of the seal line 34 serves to provide fluid communication between the chambers 12 and 16, which in the example of FIG. 6 will provide for mixing of liquids A and B. Preferably, the seal line 36 is constructed so that it will not rupture. However, it should, of course, be appreciated that seal line 36 could be constructed so that it ruptures and provides fluid communication between the chambers 14 and 16. To this end, a port would then be located at an end of chamber 14 allowing fluid to be accessed therefrom.

The sheets 18, 20, and 22 preferably are flexible and it is preferred that each sheet is made at least partially of a thermoplastic. Preferably, the sheets are made of the same material. To this end, the first sheet 18 can include an inner surface of thermoplastic material and an outer surface of the same or different material. The sheet 22 can also include an inner surface made of a thermoplastic material and an outer surface of the same or different material. The inner surfaces should have similar melt-flow characteristics. Preferably, the inner surfaces are made of the same material. As will be discussed, the sheets 18 and 22 may be laminated or co-extruded structures including multiple layers of materials to impart different properties to the sheets.

As has been discussed, the inner surfaces of the sheets 18 and 22 are secured to each other at the seal 30. The seal 30 and therefore the seal lines 34 and 36 can be formed by an energy source which melts the inner surfaces thereof at the seal 30. The energy source can be a focused energy source such as a radio frequency (RF) energy source applied through a sealing dye. The term "focused energy" is meant to include conductive heat and may include ultrasonic energy. This seal 30 can also be made by applied pressure as well as by the focused energy.

Referring to FIG. 5, it can be seen that the seal 30 includes a depressed area of decreased thickness 60 at the weld 32. The sections 22*a* and 22*b* are connected to opposite sides of the depression 60 at edges 62 and 64, respectively, edge 62 corresponding to seal line 34 and edge 64 corresponding to seal line 36. The edge 62 has an inner cross section relative to the sheet 22 that provides a break line along which the sections 22*a* can be separated from the weld 32.

As also illustrated, the seal lines 34 and 36 further comprise beads 66 and 68, respectively formed between and at the junctures of the sheets 22*a* and 18 and 22*b* and 18, respectively. This bead formation can be attributed to the result of the outward flow of the thermoplastic material as the sheets 22 and 18 are fused together. As illustrated, the break line 62 occurs at a position slightly above the bead line 66. This is similar to that phenomena observed in the formation of break lines in U.S. Pat. No. 4,770,295, FIG. 5 and accompanying description thereof, the disclosure of which is incorporated herein by reference.

In this regard, alternatively, the seal 30 can be formed specifically as described in U.S. Pat. No. 4,770,295, FIG. 5, and accompanying description thereof. It can be appreciated that each seal line would be constructed to include a bead and depression formed in opposite sides of the seal line as described.

Preferably, the thickness of the sheet 22 is at the most not substantially greater than the thickness of the sheet 18. Most preferably, the thickness of the sheet 22 is less than the thickness of the sheet 18 and, e.g., at least about 0.003 inches less than the thickness of the sheet 18. For illustration purposes only, and not as a limitation, the sheet 18 may have a thickness of 0.015 inches and the sheet 22 may have a thickness of 0.010 inches.

As stated earlier, the inner surfaces of the sheets 18 and 22 preferably are of the same material. It is believed that thermoplastic materials, i.e., polyvinyl chloride, are materials which work well in making the seal 30. The entire sheets may be made of the these materials or just the inner surfaces thereof.

Figure 3:
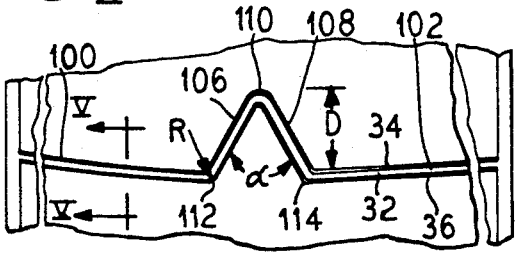
FIG. 3 is an enlarged detail of the internal tear seal of the container of FIGS. 1 and 2

With reference now to FIGS. 1, 2, and 3, a very particular aspect of the invention will now be described.

As illustrated, in front or back view, the seal 30 substantially comprises an overall W-shape, albeit somewhat flat, having two outer legs 100 and 102 and an inverted chevron or V-shape 104 having legs 106 and 108 disposed as a central portion of the seal 30. In defining the overall W-shape, it can be seen that the outer legs 100 and 102 incline slightly from the outer periphery of the container 10 toward the central portion of the container 10, preferably at an angle of 5°, thereby describing an upwardly opening obtuse angle $\beta$ (identified in FIGS. 1 and 2), preferably of about 170°. In contrast thereto, the legs 106 and 108 of the inverted central chevron define a downwardly opening, preferably acute angle $\alpha$ (identified in FIG. 3). It can be appreciated that the angle $\beta$ described by the legs 100 and 102 can vary depending on the desired shape. Therefore, the angle $\beta$ can be greater or less than 170° as needed.

As indicated in FIG. 3, the central chevron 104 includes an apex 110. The ends of the legs 106 and 108 are connected to the centrally disposed ends of the legs 100 and 102 via two reverse angles 112 and 114, which form the bottom of the W-shape. The reverse angles 112 and 114 preferably comprise radii R of 3/32 of an inch. The angle $\alpha$ described by the central chevron 104 can also vary depending on the particular application although an acute angle is probably the most effective.

Because seal lines 34 and 36 proceed parallel to each other along opposite sides of the seal 30, it can be appreciated that the seal 30 preferably comprises two parallel W-shaped seal lines. However, should only section **22*a* be provided (i.e., no chamber 14 being provided because section 22*b* is removed) then only one W-shape seal line is provided. Again, however, in the illustrated embodiment, only seal line 34** is designed to rupture upon the application of a sufficient source.

It has been determined that this shape for the seal 30 provides for obtaining a larger opening for the same amount of stretch between the sheets 18 and 22 than is possible given a single overall chevron. Further, the described internal seal provides for a seal line that is more easily openable than prior designs.

A central rupture in seal line 34 can be made by pulling apart of the sheets 18 and 22 until the central chevron portion 110 is completely broken. This appropriate pulling is accomplished, for example, by grasping both sheets 18 and **22*a* at the central chevron 104 and pulling the sheets 18 and 22 apart. Then, a larger opening can be had by continued rupture of the seal line 34 along the legs 100 and 102**.

Further, a better grip is provided which in turn makes it easier to open the seal 30, at the seal line 34, given a sufficient distance D between the apex 110 of the central chevron and the reverse angles 112 and 114, i.e., the height of the central chevron 104. The overall chevron shape prevents pooling of the liquid in the chamber 12.

It has also been determined that the most appropriate distance D for these purposes between the apex 110 of the central inverted chevron and the reverse angles 112 and 114 is greater than or equal to one inch. Various other distances have been tested with the following results for tearing along seal lines 34:

| Distance D | Result |
|---|---|
| ⅛" | Extremely hard to open. |
| ¼" | Very hard to open. |
| ½" | Somewhat easier to open, but definite resistance felt when tear reached reverse angle. |
| ¾" | Easy to open but slight resistance felt when tear reached reverse angles. |
| 1" | Easy to open |
| 1½" | Easy to open |

It can be appreciated that, although preferably only chambers 12 and 16 are employed, all of the chambers 12, 14, and 16 can be filled with substances.

Preferably, in an embodiment, each of chambers 12 and 16 is configured to enclose about 500 ml of fluid so that the resultant admixture comprises a single dose of about 1000 ml.

It can also be appreciated that due to the abovedescribed seal structure, it is easy to inspect for leaks in the container 10. This is especially true given formation of the sheet 18 with a transparent thermoplastic.

The result of the foregoing is a dual chamber container for the delivery of, for example, an admixed injection via a single nonpyrogenic single dose container.

While preferred embodiments have been shown, modifications and changes may become apparent to those skilled in the art which shall fall within the spirit and scope of the invention. It is intended that such modifications and changes be covered by the attached claims.

What is claimed is:

1. A container having at least two chambers separated by a selectively openable seal line, said container comprising an inner and two exterior sheets sealed together in registry about the peripheries thereof and forming two lateral edges, said seal line comprising a heat seal disposed between one exterior sheet and said inner sheet and across said container whereby at least a first chamber is formed between said one exterior sheet and said inner sheet and a second chamber is formed between said other exterior sheet and said inner sheet, said seal line substantially comprising in plan view a W-shape extending completely across a face of said container between the tow lateral edges thereof with tow inner legs and two outer legs, said inner legs describing an inverted central chevron portion, said outer legs defining an upwardly opening angle, each outer leg beginning at one lateral edge and ending at one inner leg.

2. The container of claim 1, wherein said inner legs define an inverted chevron describing an acute angle.

3. The container of claim 1, wherein said inner legs define an inverted chevron having a height of about 1 inch or greater.

4. The container of claim 1, wherein said inner legs are joined together at an apex, each leg joining an outer leg of the overall W-shape via a reverse angle.

5. The container of claim 4, wherein the apex of said central portion is positioned at a distance of about 1 inch or greater away from said reverse angles.

6. A container comprising at least two sheets of material secured together along peripheries of the sheets of material to form edges and including at least one W-shaped frangible seal line extending completely across a face of the container to form at least two chambers separated by said frangible seal line, said seal line comprising a heat seal, said seal line having two inner legs and two outer legs, said inner legs describing an inverted central chevron portion, said out legs defining an upwardly opening angle, each outer leg beginning at one lateral edge and ending at one inner leg.

7. The container of claim 6, wherein said at least one seal line comprises two parallel W-shaped seal lines.

8. The container of claim 6, wherein said container comprises a third sheet of material, said three sheets of material being disposed in registry and secured together about the peripheries thereof, so that an inner sheet is enclosed by two exterior sheets.

9. The container of claim 8, wherein said inner sheet is secured to one exterior sheet via said W-shaped seal line such that said inner sheet is operative to rupture along a break line of said seal line.

10. A container comprising:

first and second exterior sheets secured together about peripheries thereof to form a bag with lateral edges;

an inner sheet secured within said bag and sealed about the peripheries of said first and second exterior sheets so as to subdivide said bag into two individual larger chambers; and a W-shaped frangible seal securing a portion of said inner sheet to said first exterior sheet such that at least one individual larger chamber is subdivided into two smaller chambers, said seal extending completely across said container between the lateral edges thereof, said seal comprised of two inner legs and two outer legs, said inner legs describing an inverted central chevron portion, said outer legs defining an upwardly opening angle, each outer leg beginning at one lateral edge and ending at one inner leg.

11. The container of claim 10, wherein two outer legs describe an obtuse angle and said two inner legs describe an inverted acute angle.

12. The container of claim 10, further comprising an inlet port in communication with one of said two smaller chambers.

13. The container of claim 10, further comprising at least one outlet port in communication with said individual larger chambers.

* * * * *